US008910483B2

(12) United States Patent
Von Der Bank

(10) Patent No.: US 8,910,483 B2
(45) Date of Patent: Dec. 16, 2014

(54) LEAN PREMIX BURNER FOR A GAS-TURBINE ENGINE

(75) Inventor: Ralf Sebastian Von Der Bank, Rangsdorf (DE)

(73) Assignee: Rolls-Royce Deutschland Ltd & C (DE)

( * ) Notice: Subject to any disclaimer, the term of this patent is extended or adjusted under 35 U.S.C. 154(b) by 843 days.

(21) Appl. No.: 12/289,051

(22) Filed: Oct. 20, 2008

(65) Prior Publication Data

US 2009/0100837 A1 Apr. 23, 2009

(30) Foreign Application Priority Data

Oct. 18, 2007 (DE) ..... 10 2007 050 276

(51) Int. Cl.
*F23R 3/28* (2006.01)
*F23R 3/32* (2006.01)
*F23R 3/14* (2006.01)

(52) U.S. Cl.
CPC .... *F23R 3/32* (2013.01); *F23R 3/14* (2013.01)
USPC ..... 60/776; 60/737; 60/743; 60/748

(58) Field of Classification Search
USPC ..... 60/737, 739, 740, 748, 738, 742, 747, 60/772, 776
See application file for complete search history.

(56) References Cited

U.S. PATENT DOCUMENTS 3,474,970 A * 10/1969 Hogg et al. ..... 239/404
3,530,667 A * 9/1970 Robert ..... 60/743
3,684,186 A 8/1972 Helmrich
3,703,259 A * 11/1972 Sturgess et al. ..... 239/400
3,980,233 A 9/1976 Simmons et al.
4,170,108 A * 10/1979 Mobsby ..... 60/740
4,260,367 A * 4/1981 Markowski et al. ..... 431/353
4,327,547 A * 5/1982 Hughes et al. ..... 60/39.463
4,470,262 A * 9/1984 Shekleton ..... 60/737

(Continued)

FOREIGN PATENT DOCUMENTS

DE 19527453 1/1997
DE 19729246 1/1999

(Continued)

OTHER PUBLICATIONS

German Search Report dated Oct. 31, 2008 from counterpart German patent application No. 102007050276.3.

(Continued)

*Primary Examiner* — Phutthiwat Wongwian
*Assistant Examiner* — Michael B Mantyla
(74) *Attorney, Agent, or Firm* — Timothy J. Klima; Shuttleworth & Ingersoll, PLC

(57) ABSTRACT

A lean premix burner for a gas-turbine engine includes an annular center body (3) with a conically flaring fuel film applicator (11) supplied with fuel via an annular distributor chamber (14) and fuel channels (12) as well as air ducts (7, 9) with swirler elements (8, 10) provided on the outer and inner circumference. A fuel prefilmer lip (15) is attached to the fuel film applicator (11), with a flow area of a portion of the annular air ducts (7, 9) downstream of the swirler elements (8, 10) decreasing to accelerate the air swirled in correspondence with the airflow direction. By this, the fuel is transported positively without interim separation and without the occurrence of compressive oscillation—to a defined flow breakaway edge (16), providing for a good mixture, high combustion efficiency and reduced formation of nitrogen oxide.

19 Claims, 2 Drawing Sheets

(56) References Cited

U.S. PATENT DOCUMENTS

Figure 1:
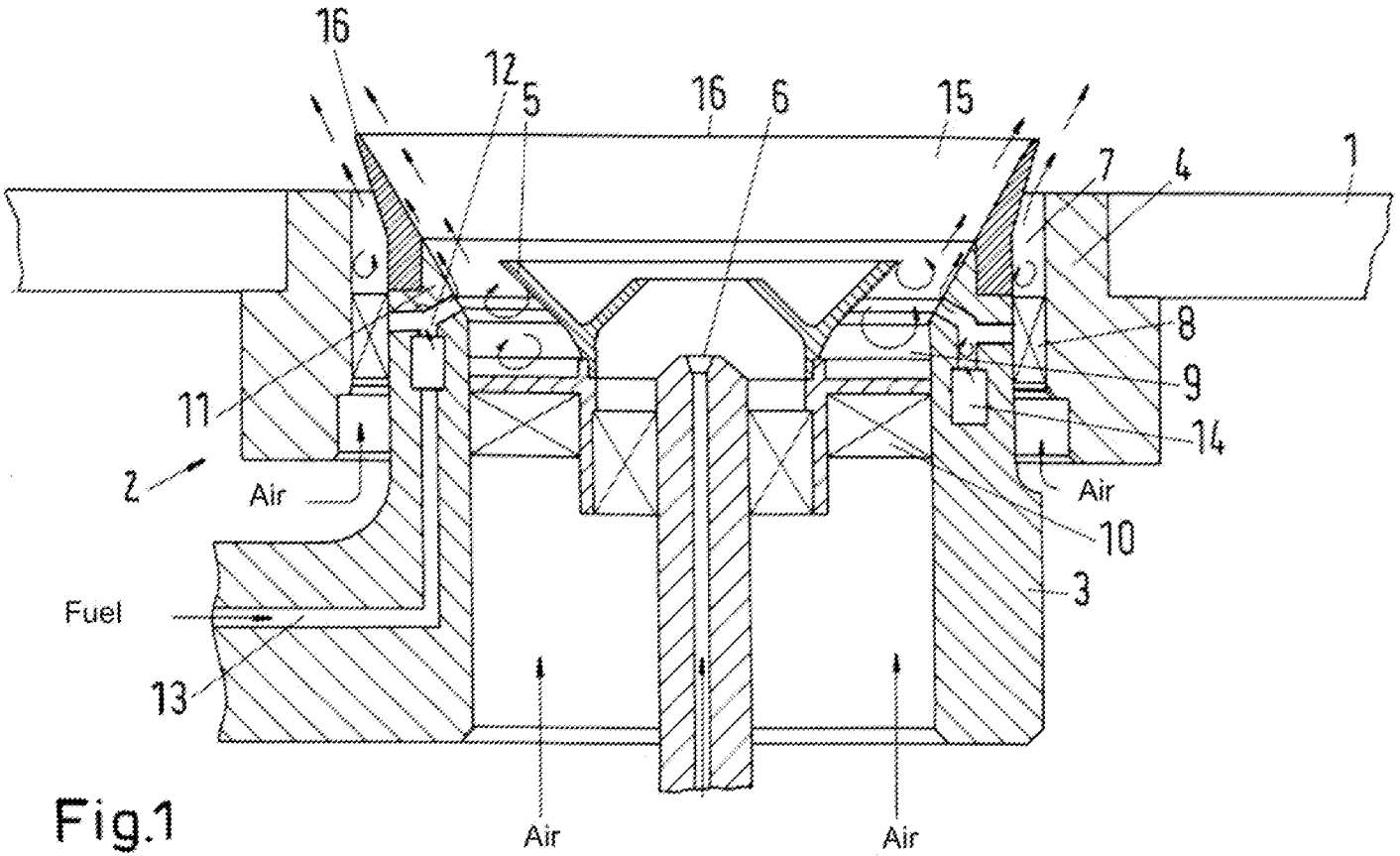

| | | | | |
|---|---|---|---|---|
| 5,042,445 | A * | 8/1991 | Peters et al. | 123/446 |
| 5,417,070 | A * | 5/1995 | Richardson | 60/748 |
| 5,490,389 | A * | 2/1996 | Harrison et al. | 60/737 |
| 6,035,645 | A * | 3/2000 | Bensaadi et al. | 60/742 |
| 6,161,387 | A * | 12/2000 | Green | 60/748 |
| 6,345,505 | B1 * | 2/2002 | Green | 60/748 |
| 6,389,815 | B1 * | 5/2002 | Hura et al. | 60/746 |
| 6,530,227 | B1 * | 3/2003 | Young et al. | 60/776 |
| 6,718,770 | B2 * | 4/2004 | Laing et al. | 60/740 |
| 6,898,938 | B2 * | 5/2005 | Mancini et al. | 60/748 |
| 7,010,923 | B2 * | 3/2006 | Mancini et al. | 60/776 |
| 7,086,234 | B2 | 8/2006 | Doerr et al. | |
| 7,090,205 | B2 * | 8/2006 | Oda et al. | 261/78.1 |
| 7,434,401 | B2 * | 10/2008 | Hayashi | 60/743 |
| 8,128,007 | B2 * | 3/2012 | Thomson et al. | 239/405 |
| 8,146,837 | B2 * | 4/2012 | Thomson et al. | 239/405 |
| 8,156,746 | B2 * | 4/2012 | Buelow et al. | 60/776 |
| 8,171,734 | B2 * | 5/2012 | McMasters et al. | 60/748 |
| 8,171,735 | B2 * | 5/2012 | Mancini et al. | 60/748 |
| 8,225,612 | B2 * | 7/2012 | Oda et al. | 60/748 |
| 8,327,643 | B2 * | 12/2012 | Yamamoto et al. | 60/743 |
| 8,336,313 | B2 * | 12/2012 | McMasters et al. | 60/742 |
| 8,387,391 | B2 * | 3/2013 | Patel et al. | 60/740 |
| 8,429,914 | B2 * | 4/2013 | Gashi et al. | 60/748 |
| 8,443,609 | B2 * | 5/2013 | Doerr et al. | 60/740 |
| 8,555,645 | B2 * | 10/2013 | Duncan et al. | 60/737 |
| 2002/0092302 | A1 * | 7/2002 | Johnson et al. | 60/737 |
| 2002/0178732 | A1 * | 12/2002 | Foust et al. | 60/776 |
| 2003/0141383 | A1 | 7/2003 | Hayashi | |
| 2004/0079086 | A1 * | 4/2004 | Smith et al. | 60/776 |
| 2005/0028525 | A1 * | 2/2005 | Toon et al. | 60/737 |
| 2005/0097889 | A1 * | 5/2005 | Pilatis et al. | 60/743 |
| 2005/0198964 | A1 * | 9/2005 | Myers et al. | 60/739 |
| 2007/0084215 | A1 * | 4/2007 | Hernandez et al. | 60/796 |
| 2007/0157617 | A1 * | 7/2007 | von der Bank | 60/743 |
| 2007/0289306 | A1 * | 12/2007 | Suria et al. | 60/748 |
| 2008/0289340 | A1 * | 11/2008 | Oda et al. | 60/737 |
| 2009/0113893 | A1 * | 5/2009 | Li et al. | 60/737 |

FOREIGN PATENT DOCUMENTS

| | | |
|---|---|---|
| DE | 102005022772 | 1/2007 |
| EP | 1331441 | 7/2003 |
| EP | 1359376 | 11/2003 |
| EP | 1413830 | 4/2004 |
| EP | 1801504 | 6/2007 |

OTHER PUBLICATIONS

European Search Report dated Feb. 23, 2009 from counterpart European patent application No. 08165427.9.

* cited by examiner

LEAN PREMIX BURNER FOR A GAS-TURBINE ENGINE

This application claims priority to German Patent Application DE102007050276.3 filed Oct. 18, 2007, the entirety of which is incorporated by reference herein.

The present invention relates to lean premix burner for a gas-turbine engine which includes an annular center body with a conically flaring fuel film applicator supplied with fuel via an annular distributor chamber and fuel channels and annular air ducts with swirler elements provided on the outer and inner circumferences.

Combustion chambers of gas-turbine engines can be provided with lean premix burners in order to enable a fuel-air mixture with high content of air to be burned in the combustion chamber at low combustion temperature and with correspondingly reduced formation of nitrogen oxide. In order to ensure ignition of the lean air-fuel mixture under any condition, for example also at low ambient temperatures and correspondingly adverse vaporization behavior, it is further known to combine the burner with a centrally arranged supporting burner and a flame stabilizer. Such burners can also be provided with an annular atomizer lip having a circumferential fuel film application surface, as described in Specification EP 1 801 504, for example. A continuous fuel film is applied to the film application surface—uniformly distributed by supply ducts issuing at the film application surface—which is acted upon by a concentric airflow caused to swirl by swirler elements. This enables a high atomization effect and an intense mixture of air and fuel can be obtained. A further combustion airflow is supplied via an annular air duct provided with swirler elements which is positioned at the outer circumference of the atomizer lip of the burner.

However, as the film application surface is usually smooth, positive attachment of the fuel film is not fully ensured, i.e. the airflow, and thus the fuel film, may separate from the film application surface, particularly if the flow at the atomizer lip is decelerated, i.e. has concave stream lines. This results in a non-uniform, circumferentially point-type fuel distribution. Moreover, separation of both, the air flow and the fuel film from the prefilmer lip surface will lead to turbulent instabilities which may give rise to pressure oscillations of high amplitude.

In a broad aspect, the present invention provides a design of a lean premix burner of the type mentioned at the beginning above such that a stable, uniformly distributed fuel film is produced at the film application surface, which detaches uniformly at the flow break-away edge and generates a fine droplet mist to ensure quiet combustion at low temperature, low nitrogen oxide formation and good combustion efficiency.

The basic idea of the present invention is the provision of a fuel prefilmer lip following the fuel film applicator. Since the flow area of the air ducts downstream of the swirler elements decreases towards the exit side, such that the swirling air is accelerated in the flow direction of the fuel film along the prefilmer lip surface, thereby continuously pressing the fuel film against the fuel prefilmer lip onto the entire prefilmer surface while transporting it positively and without interim separation to the flow-break-away edge provided at the free end of the fuel prefilmer lip. The swirling air, which is flowing in the air duct opposite the film application surface is also accelerated by virtue of a gradually decreasing cross-section, thereby providing that the fuel film positively detaches at the flow break-away edge and that, upon detachment, good mixing with reduced turbulent excitation of the fuel uniformly exiting at the flow break-away edge is ensured in the shear layer between the two adjacent, co-directionally or counter-directionally swirling annular air streams. By virtue of the forced convection of the fuel, uncontrolled break-up of the fuel at the film application surface is avoided, thereby significantly reducing the occurrence of turbulences and pressure oscillations. Thus, quiet combustion at low temperature, low nitrogen oxide formation and good combustion efficiency is ensured.

According to another feature of the present invention, the fuel channels issue at the fuel film application surface at an angle equal to or larger than 90°. In addition, the fuel is introduced into the fuel channels issuing at the film application surface via obliquely oriented openings, thereby producing a swirling effect. The swirl direction of the fuel agrees with the swirl direction of the swirling air acting upon the fuel film. Thus, separation-free transport of the fuel film to the flow break-away edge is further assisted.

According to a further feature of the present invention, the free end of the fuel applicator lip is sharp-edge shaped, i.e. not rounded, thereby creating a well defined flow break-away edge for the fuel film. Thus, the fuel is prevented from flowing to the opposite side. This is further prevented by the swirled, accelerated airflow at the side opposite the flow break-away edge.

The swirler elements (guide vanes) in the two air ducts are designed such that the air shear layers at the prefilmer lip surface and at the surface opposite the film application surface are co-directionally or counter-directionally swirled. The swirling air can be generated by aerodynamically profiled guide vane like swirler elements.

Preferably, the fuel film is applied on the inner surface of the fuel prefilmer lip. However, the fuel film may also be produced on the outer surface of the fuel prefilmer lip or simultaneously on both surfaces. Moreover, the fuel quantities supplied to the fuel prefilmer lip at the inner and outer surfaces may be different. The fuel channels leading to the fuel film applicator can be fully or partly filled with fuel.

According to a yet another feature of the present invention, the lean premix burner includes a V-shroud flame stabilizer, and the upper edge of the outer flank of the flame stabilizer can be situated in an area which may extend from the fuel film applicator to beyond the flow break-away edge of the fuel prefilmer lip.

The flow break-away edge of the fuel prefilmer lip can be positioned in an area from upstream to downstream of the front side of the outer ring of the burner.

In a further embodiment of the present invention, the pilot fuel injector is provided as a pressure atomizer or air-blast atomizer or a combination of both.

The components of the lean premix burner according to the present invention are made of heat-resistant steel, ceramics and ceramics-steel composites. Furthermore, designs using non-ferrous metals and plastics are possible.

The present invention is more fully described in light of the accompanying drawings showing a preferred embodiment. In the drawings, FIG. 1 is a schematic sectional representation of a lean premix burner with a fuel prefilmer lip attached to the fuel film applicator, FIG. 2 is an enlarged schematic representation in the area of the fuel film applicator and the attached fuel prefilmer lip.

The lean premix burner 2 shown schematically in the drawing, which is included in a combustion chamber wall 1, features an annular center body 3 which is surrounded by an outer ring 4 and includes a centrally integrated pilot fuel injector 6 surrounded by a V-shroud flame stabilizer 5. The pilot fuel injector 6 can be a pressure atomizer, an air-blast atomizer, a combination of both, or of a different configuration. Disposed between the center body 3 and the outer ring 4 is a first annular air duct 7 with first swirler elements 8, and a second annular air duct 9 with second swirler elements 10 is positioned between the center body 3 and the V-shroud flame stabilizer 5. The conically flaring end portion of the center body 3 facing the combustion chamber is a fuel film applicator 11 which has a smooth inner surface at which one or more fuel channels 12 issue. The fuel is supplied to the fuel channels 12 via an annular distribution chamber 14 disposed in the center body 3 and connecting to a supply line 13. The one or more fuel channels 12 can be in the form of a single annular channel, a plurality of divided semi-circumferential channels and/or a plurality of separate circumferentially positioned ports. Following the fuel film applicator 11, a fuel prefilmer lip 15 is provided at the upper rim of the center body 3.

Figure 2:
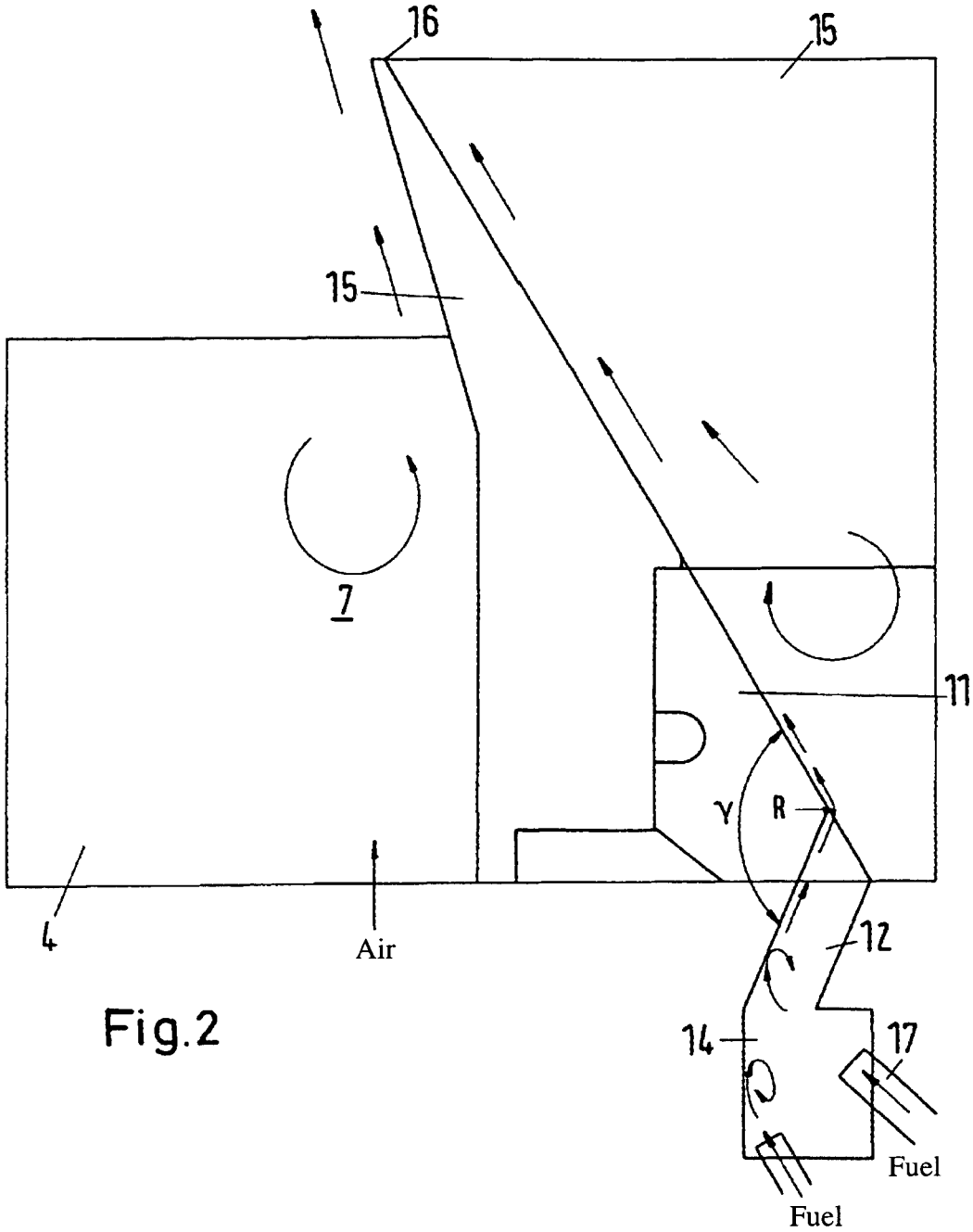

Fuel supply to the annular distributor chamber 14 is accomplished, as shown in FIG. 2, via openings 17 orientated obliquely to the outer wall of the chamber so that the fuel uniformly flows along the outer wall of the fuel channels 12 to the surface of the fuel film applicator 11. The fuel channels 12 are oriented to the surface of the fuel film applicator 11 at an angle $\gamma >> 90°$ so that the fuel is guided in a large radius R immediately onto the surface of the fuel film applicator 11 and a uniform fuel film is produced.

The fuel channels 12 can supply fuel to one or both of an inner surface and an outer surface of one or both of the fuel film applicator 11 and the fuel prefilmer lip 15 for the formation of the fuel film. When fuel is supplied to both inner and outer surfaces, it can be supplied in equal or different quantities to the different surfaces. The fuel channels 12 can be partly or fully filled with fuel.

The first and second swirler elements 8 and 10 each include a guide vane assembly with aerodynamically shaped vanes so that a uniform airflow is applied to the fuel film applicator and the fuel prefilmer lip—and thus the fuel film. Also, the cross-sectional area of the first and the second annular air ducts 7 and 9 gradually decreases behind the swirler elements 8 and 10 so that the air is accelerated, thus positively transporting the fuel film to the flow break-away edge 16 at the upper rim of the fuel prefilmer lip 15. By virtue of the velocity increase of a stable airflow acting continuously upon the fuel film, the fuel film is permanently pressed against the film application surface and accelerated, thus being enabled to reach the flow-break-away edge 16 without separation and turbulence instabilities.

Furthermore, the first swirl air acting at the rear side of the fuel prefilmer lip 15 provides that the fuel film is hindered from flowing around the free end of the fuel prefilmer lip and positive detachment of the fuel film is ensured. In order to ensure detachment of the fuel film at the free end of the fuel prefilmer lip 15, a flow break-away edge 16 is there provided in that the tip forms a straight—under no circumstances rounded—surface oriented at a certain angle to the film application surface.

As shown in the drawing, the air exit cross-section in the first air duct 7 behind the first swirler element 8 is smaller than the air exit cross-section in the second air duct 9 behind the second swirler element 10. Moreover, the swirling of air at the first swirler element 8 can be equal to or less than the swirling at the second swirler element 10. The velocity difference and the difference in the air mass flow between the first and the second swirl air supplied via the first and second air ducts 7 and 9, respectively, then provide for intense mixture of fuel and air upon detachment of the fuel film at the flow break-away edge 16. The above-described measures ultimately create the prerequisites for quiet combustion, good temperature distribution, high combustion efficiency and low nitrogen oxide formation.

In the present example, the air in the first swirler element 8 is swirled opposite to the swirling direction of the air in the second swirler element 10 (counter-directional swirl). However, it is also possible that the air in the first and second air ducts 7, 9 is swirled in the same direction (co-directional swirl).

An upper edge of an outer flank of the V-shroud flame stabilizer 5 can be configured to end in an area which extends beyond a flow break-away edge 16 of the fuel prefilmer lip 15, or which does not extend beyond a flow break-away edge 16 of the fuel prefilmer lip 15. The flow break-away edge 16 can be disposed in an area downstream or upstream of a front side of an outer ring 4 of the burner 2.

LIST OF REFERENCE NUMERALS

1 Combustion chamber wall
2 Lean premix burner
3 Center body
4 Outer ring
5 V-shroud flame stabilizer
6 Pilot injector, pilot fuel injector, pilot burner
7 First air duct
8 First swirler element
9 Second air duct
10 Second swirler element
11 Fuel film applicator
12 Fuel channel
13 Supply line
14 Annular distributor chamber
15 Fuel prefilmer lip
16 Flow break-away edge
17 Fuel supply opening

What is claimed is:

1. A lean premix burner for a gas-turbine engine, comprising:

an annular center body having a conically flaring fuel film applicator;

an annular fuel distribution chamber;

at least one annular fuel channel for receiving fuel from the annular fuel distribution chamber and supplying fuel to a radially inner surface of the fuel film applicator and a radially outer surface of the fuel film applicator, or to the radially outer surface of the fuel film applicator;

a first annular air duct having a first swirler element positioned on an outer circumference of the annular center body;

a second annular air duct having a second swirler element positioned on an inner circumference of the annular center body;

a V-shroud flame stabilizer at least partially positioned within the inner circumference of the annular center body;

a pilot fuel injector positioned radially inwardly of the V-shroud flame stabilizer;

a fuel prefilmer lip attached to the fuel film applicator and configured to extend downstream beyond an adjacent wall of a combustion chamber wall into a combustion chamber of the gas-turbine engine, at least a portion of the fuel prefilmer lip being the most downstream portion of the lean premix burner, an entirety of the V-shroud flame stabilizer positioned upstream of the most downstream portion of the fuel prefilmer lip;

wherein a flow area of the first annular air duct downstream of the first swirler element and upstream of a free end of the fuel prefilmer lip decreases with respect to a flow area of the first swirler element to accelerate air flowing in the first annular duct, and a flow area of the second annular air duct downstream of the second swirler element and upstream of the free end of the fuel prefilmer lip decreases with respect to a flow area of the second swirler element to accelerate air flowing in the second annular duct, the flow area of the second annular air duct steadily decreasing past and substantially downstream of the at least one annular fuel channel to steadily accelerate the air flowing in the second annular duct past and substantially downstream of the at least one annular fuel channel, the accelerated air in each of the annular ducts being imparted with swirl directions to act upon a fuel film of the fuel film applicator corresponding to a flow direction of the fuel film.

2. A lean premix burner in accordance with claim 1, and further comprising fuel openings issuing into at least one of the at least one annular fuel channel and the annular distributor chamber, which fuel openings are oriented to generate a fuel swirl in the at least one annular fuel channel that corresponds to the swirl direction of the air acting upon the fuel film.

3. A lean premix burner in accordance with claim 2, wherein the at least one annular fuel channel is oriented at an obtuse angle to the surface of the fuel film applicator.

4. A lean premix burner in accordance with claim 1, wherein the free end of the fuel prefilmer lip is formed as a plane surface with opposite edges to create a well-defined flow break-away edge for the fuel film.

5. A lean premix burner in accordance with claim 1, wherein the flow cross-sections in the first and second annular air ducts are different to achieve a defined air distribution.

6. A lean premix burner in accordance with claim 1, wherein the first and second swirler elements include guide vane assemblies with aerodynamic profile shaped guide vanes.

7. A lean premix burner in accordance with claim 1, wherein the first swirler element generates a first circumferential swirl of air in the first annular duct and the second swirler element generates a second circumferential swirl of air in the second annular duct and the first and second circumferential swirls of air swirl in a same rotating direction.

8. A lean premix burner in accordance with claim 1, wherein fuel is supplied to at least one chosen from of a radially inner surface and a radially outer surface of at least one chosen from the fuel film applicator and the fuel prefilmer lip for the formation of the fuel film.

9. A lean premix burner in accordance with claim 8, wherein the at least one annular fuel channel issues equal quantities of fuel to both the radially inner surface and the radially outer surface of the at least one chosen from the fuel film applicator and the fuel prefilmer lip.

10. A lean premix burner in accordance with claim 9, wherein the at least one annular fuel channel is only partly filled with fuel.

11. A lean premix burner in accordance with claim 1, wherein the pilot fuel injector is at least one of a pressure atomizer, an air-blast atomizer type, and a combination of both.

12. A lean premix burner in accordance with claim 1, wherein an upper edge of an outer flank of the V-shroud flame stabilizer ends in an area which extends beyond a flow break-away edge of the fuel prefilmer lip.

13. A lean premix burner in accordance with claim 4, wherein the flow break-away edge is positioned in an area downstream of a front side of an outer ring of the burner.

14. A lean premix burner in accordance with claim 1, wherein the first swirler element generates a first circumferential swirl of air in the first annular duct and the second swirler element generates a second circumferential swirl of air in the second annular duct and the first and second circumferential swirls of air swirl in a counter-rotating direction.

15. A lean premix burner in accordance with claim 8, wherein the at least one annular fuel channel issues fuel to both the radially inner surface and the radially outer surface of the at least one chosen from the fuel film applicator and the fuel prefilmer lip, with quantities of fuel being issued to the inner and outer surfaces being different.

16. A lean premix burner in accordance with claim 9, wherein the at least one annular fuel channel is fully filled with fuel.

17. A lean premix burner in accordance with claim 1, wherein the at least one annular fuel channel supplies fuel to the radially inner surface of the fuel film applicator and the radially outer surface of the fuel film applicator.

18. A method for providing a lean premix combustion for a gas-turbine engine, comprising:

providing a lean premix burner having:

an annular center body having a conically flaring fuel film applicator;

an annular fuel distribution chamber;

at least one annular fuel channel for receiving fuel from the annular fuel distribution chamber and supplying fuel to a radially inner surface of the fuel film applicator and a radially outer surface of the fuel film applicator, or to the radially outer surface of the fuel film applicator;

a first annular air duct having a first swirler element positioned on an outer circumference of the annular center body;

a second annular air duct having a second swirler element positioned on an inner circumference of the annular center body;

a V-shroud flame stabilizer at least partially positioned within the inner circumference of the annular center body;

a pilot fuel injector positioned radially inwardly of the V-shroud flame stabilizer;

a fuel prefilmer lip attached to the fuel film applicator and configured to extend downstream beyond an adjacent wall of a combustion chamber wall into a combustion chamber of the gas-turbine engine, at least a portion of the fuel prefilmer lip being the most downstream portion of the lean premix burner, an entirety of the V-shroud flame stabilizer positioned upstream of the most downstream portion of the fuel prefilmer lip;

providing that a flow area of the first annular air duct downstream of the first swirler element and upstream of a free end of the fuel prefilmer lip decreases with respect to a flow area of the first swirler element to accelerate air flowing in the first annular duct, and a flow area of the second annular air duct downstream of the second swirler element and upstream of the free end of the fuel prefilmer lip decreases with respect to a flow area of the second swirler element to accelerate air flowing in the second annular duct;

providing that the flow area of the second annular air duct steadily decreases past and substantially downstream of the at least one annular fuel channel to steadily accelerate the air flowing in the second annular duct past and substantially downstream of the at least one annular fuel channel;

imparting the accelerated air in each of the annular ducts with swirl directions to act upon a fuel film of the fuel film applicator corresponding to a flow direction of the fuel film.

19. A method in accordance with claim 18, wherein the at least one annular fuel channel supplies fuel to the radially inner surface of the fuel film applicator and the radially outer surface of the fuel film applicator.

* * * * *